US007641507B2

(12) United States Patent
Ko

(10) Patent No.: US 7,641,507 B2
(45) Date of Patent: Jan. 5, 2010

(54) CABLE CONNECTOR

(75) Inventor: David Tso-Chin Ko, Fullerton, CA (US)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/313,239

(22) Filed: Nov. 17, 2008

(65) Prior Publication Data

US 2009/0130888 A1 May 21, 2009

(30) Foreign Application Priority Data

Nov. 16, 2007 (CN) ..... 2007 1 0190349

(51) Int. Cl.
*H01R 12/24* (2006.01)

(52) U.S. Cl. ..... 439/497; 439/597

(58) Field of Classification Search ..... 439/497, 439/597, 607, 610
See application file for complete search history.

(56) References Cited

U.S. PATENT DOCUMENTS 6,619,985 B1 9/2003 Ko
6,659,791 B1 * 12/2003 Ko et al. ..... 439/353
6,705,893 B1 * 3/2004 Ko ..... 439/607
* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

A cable connector includes an insulative housing, some terminals, an insert and a shield. The insulative housing includes a main body, a pair of side arms respectively rearward extending from the middle of the two sides of the main body to form a receiving space between the two side arms. The forward section of said main body is a mating portion with some evenly disposed grooves. The rearward section of said main body is a connecting portion with some troughs corresponding to the grooves. Each side arm includes two pair of separated receiving slots on the tail thereof to be connected to the receiving space. Each of terminals includes a mating piece on the forward part thereof to be received in the mating portion and a connecting piece on the rearward part thereof to be received in the connecting portion. The insert includes a main body with a grid to form some passages corresponding to the troughs of the housing and two pair of fastening portions respectively extending from two sides of the main body. The main body of insert is received in the receiving space between the two side arms of the housing through said fastening portions being inserted into the receiving slots of the housing. The shield includes an upper cover assembled on the upper surface of the housing to cover the connecting portion and the insert, and a lower cover assembled on the lower surface of the housing to cover the connecting portion and the insert.

11 Claims, 8 Drawing Sheets

CABLE CONNECTOR

BACKGROUND OF THE INVENTION

1. Field of the Invention

The present invention relates generally to a cable connector, and more particularly to a low-structure cable connector used to transmit electrical signals between a liquid crystal display and a mother board.

2. Description of the Prior Art

Miniaturization is a trend for portable electric devices. Thus, connectors, used in the portable electric devices, becomes thinner and smaller. U.S. Pat. No. 6,619,985 discloses a micro coaxial cable connector. The micro coaxial cable connector comprises an insulative housing, a terminal block, a grounding plate, and a metal shield. The micro coaxial cable connector has a shield firmly assembly on a redesigned dielectric housing. However, the grounding plate and the terminal block of the connector are received in the housing, so that the housing has a receiving space with a lower wall to receive the grounding plate and the metal shield. Both the wall of the receiving space and the grounding plate have a certain height, thus, it is difficult to make the connector thinner because of the connector's complicated components.

Hence, in this art, a cable connector to overcome the above-mentioned disadvantages of the prior art should be provided.

BRIEF SUMMARY OF THE INVENTION

A primary object, therefore, of the present invention is to provide a cable connector with low structure.

In order to implement the above object, the cable connector comprises an insulative housing, some terminals, an insert and a shield. The insulative housing comprises a main body, a pair of side arms respectively rearward extending from the middle of the two sides of the main body to form a receiving space between the two side arms. The forward section of said main body is a mating portion with some evenly disposed grooves. The rearward section of said main body is a connecting portion with some troughs corresponding to the grooves. Each side arm comprises two pair of separated receiving slots on the tail thereof to be connected to the receiving space. Each of terminals comprises a mating piece on the forward part thereof to be received in the mating portion and a connecting piece on the rearward part thereof to be received in the connecting portion. The insert comprises a main body with a grid to form some passages corresponding to the troughs of the housing and two pair of fastening portions respectively extending from two sides of the main body. The main body of insert is received in the receiving space between the two side arms of the housing through said fastening portions being inserted into the receiving slots of the housing. The shield comprises an upper cover assembled on the upper surface of the housing to cover the connecting portion and the insert, and a lower cover assembled on the lower surface of the housing to cover the connecting portion and the insert.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
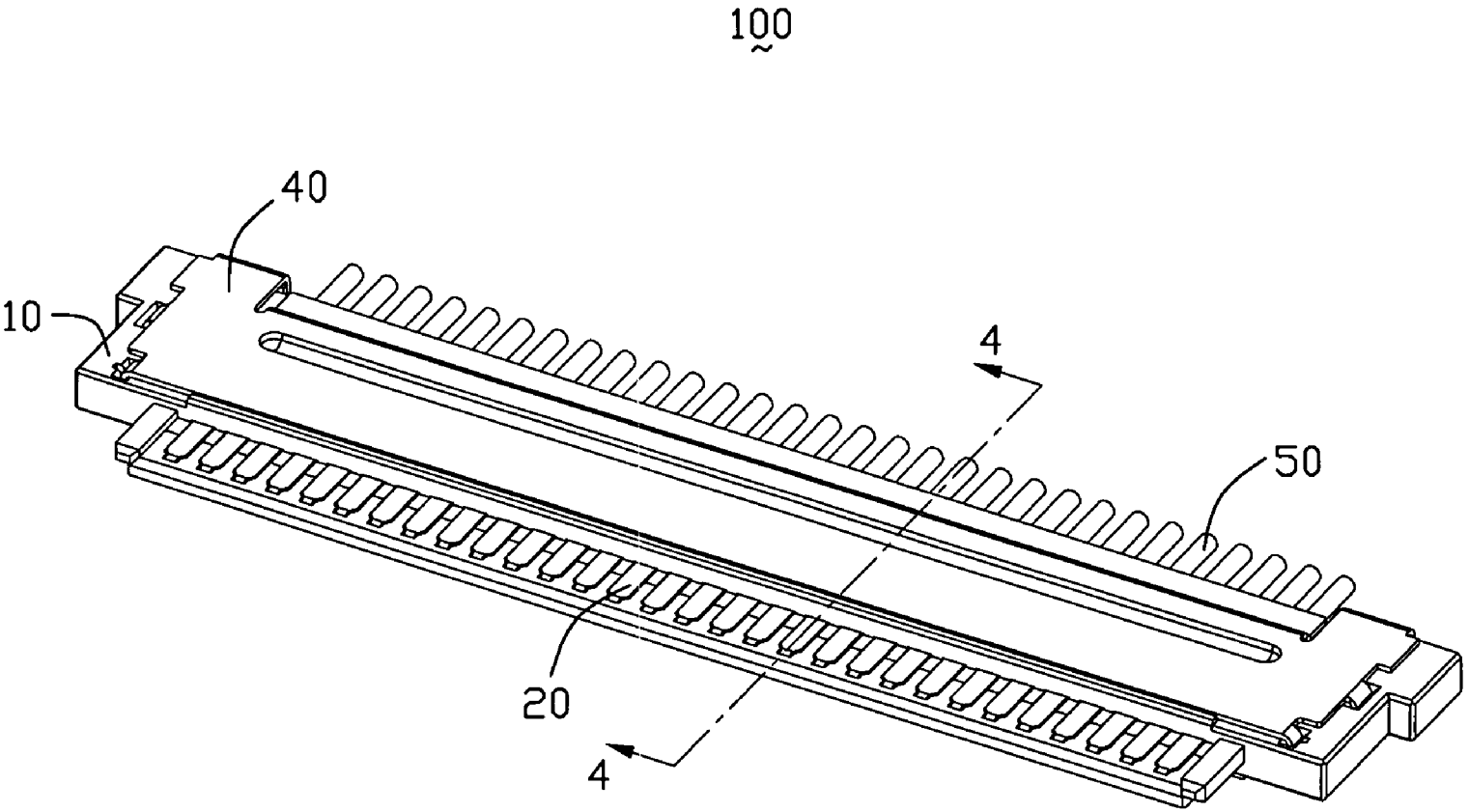
FIG. 1 is a perspective view illustrating a first embodiment of a cable connector in according with the present invention.
Figure 2:
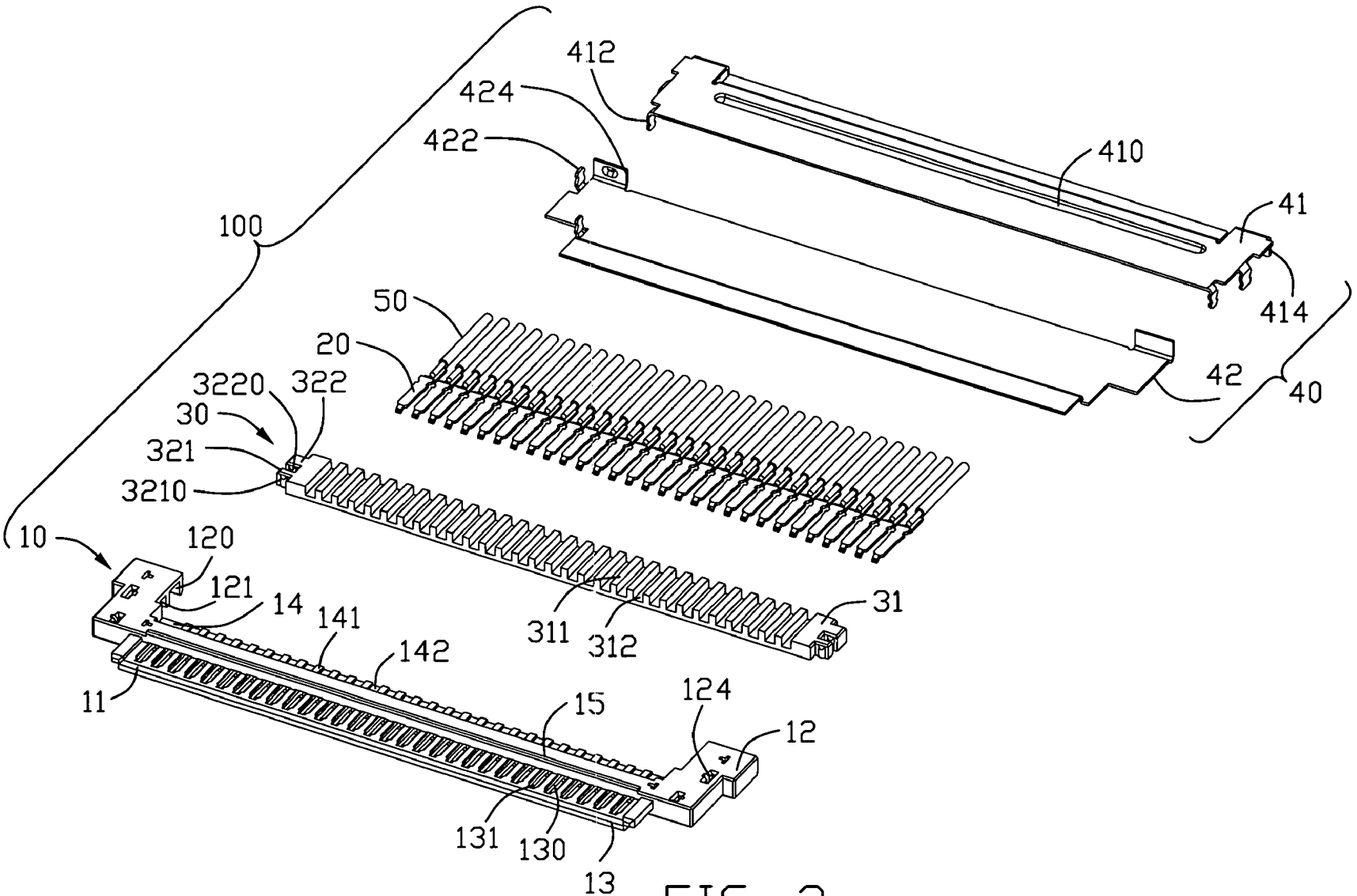
FIG. 2 is an exploded, perspective view of FIG. 1.
Figure 3:
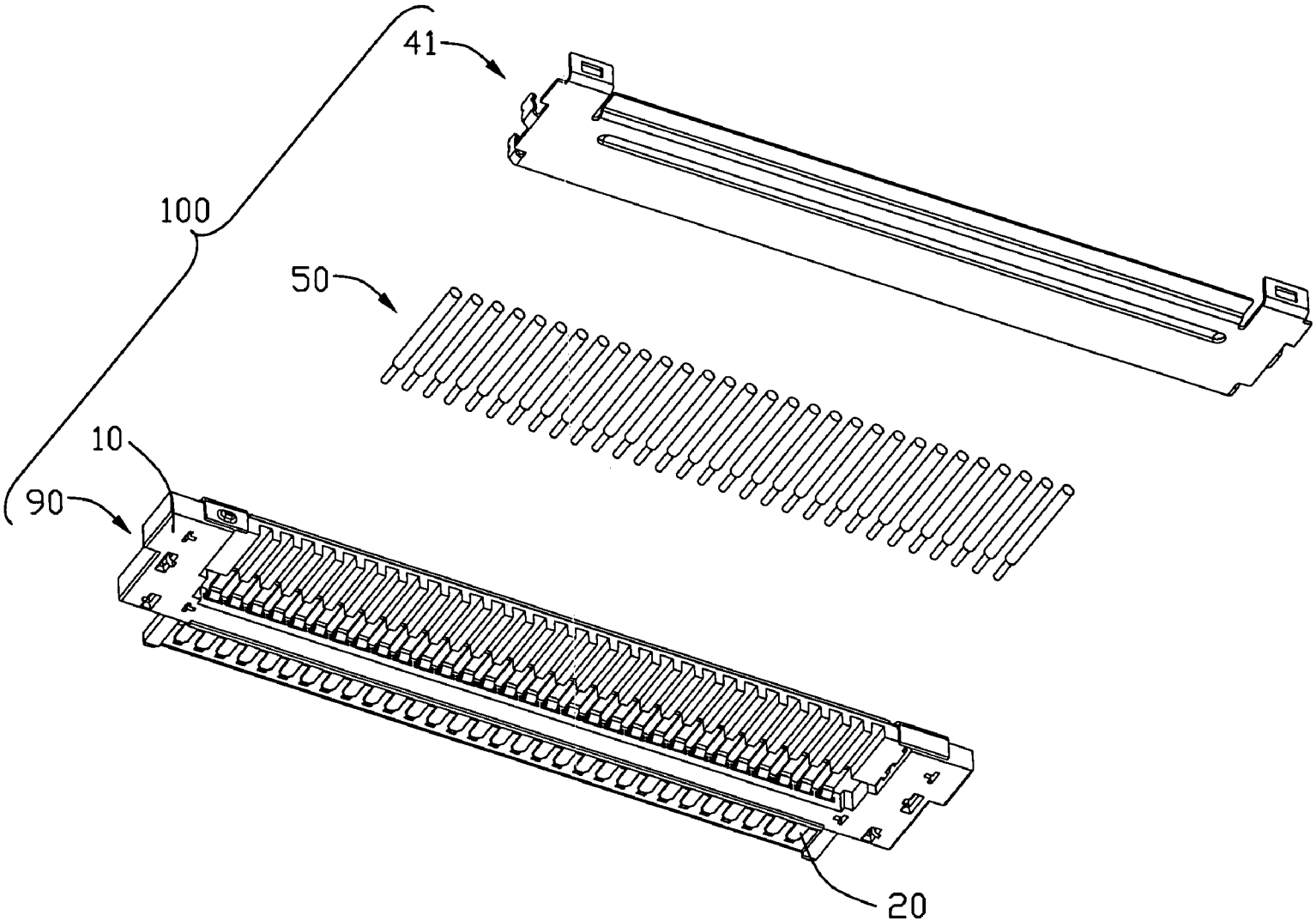
FIG. 3 is a partially assembled view of the cable connector assembly of FIG. 2.
Figure 4:
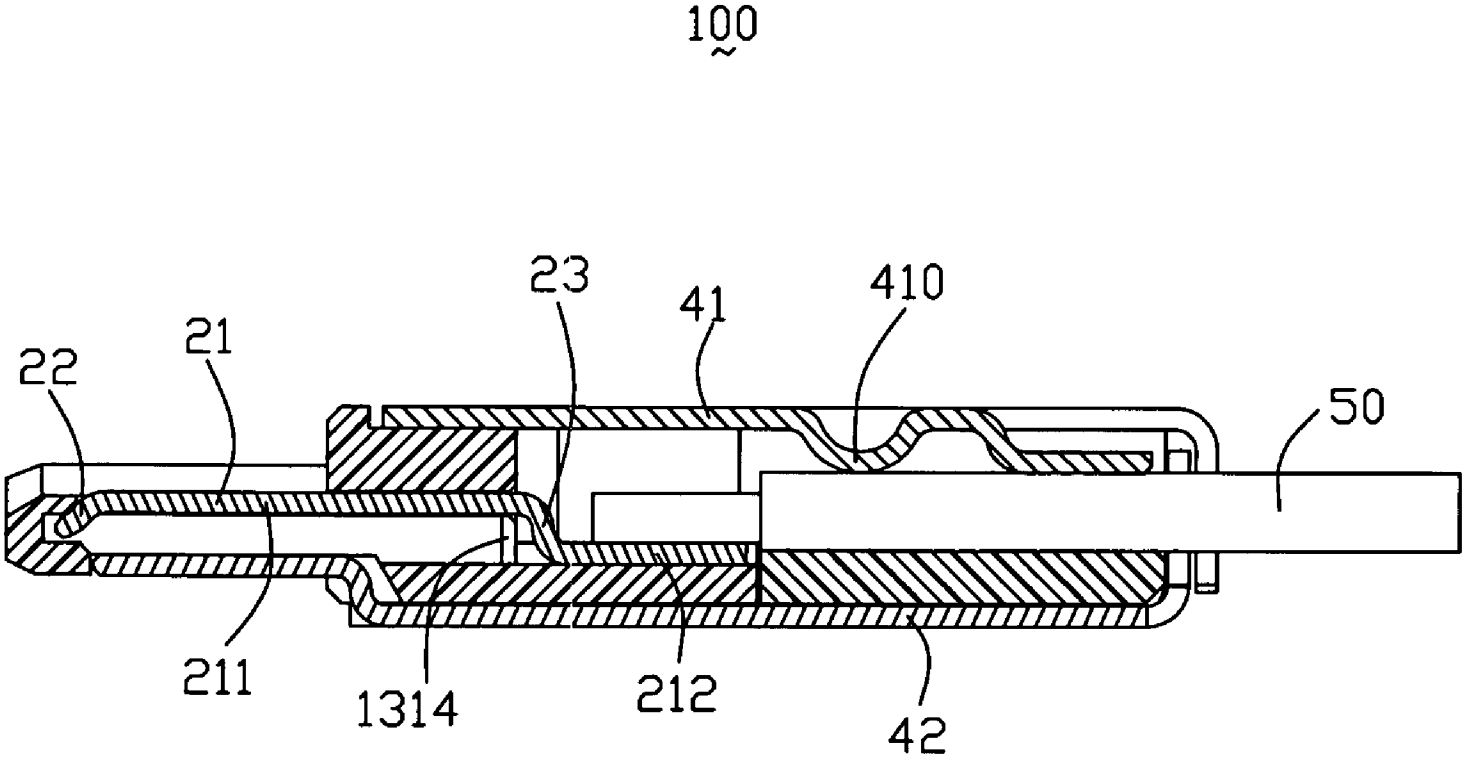
FIG. 4 is a cross-section view taken along lines 4-4 of FIG. 1.

Reference to FIG. 1 and FIG. 4, a cable connector in according with a first embodiment of the present invention is shown. The cable connector 100 comprises an insulative housing 10, a group of terminals 20, an insert 30, a metal shield 40 and some wires 50.

The terminals 20 are respectively received in the housing 10. Each terminal 20 comprises a lathy mating piece 211 to form the forward part thereof, a lathy connecting piece 212 to form the rearward part thereof and a slight protrusion 21 forward extending from the middle of the nose of the mating piece 211. The mating piece 211 is higher than the connecting piece 212 to form a step-shape structure.

The insulative housing 10 comprises a first main body 11 and a pair of block-shape, side arms 12 rearward extending from the middle of two sides of the housing 11. The main body 11 comprises a mating portion 13 to form a forward section thereof, a supporting portion 14 to form a rearward section thereof, and a bar 15 across the mating portion 13 to be connected to said two side arms 12. The mating portion 13 has some grooves 130, each of which is aligned with each other, to receive the mating pieces 211 of the terminals 20. Thus, the bar 15 crosses all grooves 130 to presses the terminals 20 received in the housing 10 to protect these terminals 20 from moving. Each groove 130 has a contracting portion 131 on the front end thereof to receive the protrusions 22 of the terminals 20. The supporting portion 14 has a grid 141 to form some troughs 142 respectively corresponding to the grooves 130 of the mating portion 13 to receive the connecting pieces 212 of the terminals 20. The grooves 130 are on the upper surface of the mating portion 13 and the troughs 142 are on the upper surface of the supporting portion 14. The mating portion 13 is higher than the supporting portion 14 to form a step-shape structure 1314 corresponding to the same structure of the terminals 20. A receiving space without upper or lower limit is formed between the two tails of the two side arms 12. Each side arm 12 comprises two separated half-open receiving slots 120, 121 on the lower surface of the tail thereof to be connected to the receiving space, and some holes 124 irregularly distributed thereon.

The metal shield 40 comprises an upper cover 41 and a lower cover 42. Both the upper cover 41 and the lower cover 42 are designed to adapt to the shape of the housing 10. A few of fixing pieces 412, 422 respectively extend from the two sides of both the upper cover 41 and the lower cover 42 to fix the metal shield 40 on the housing 10. The site of the fixing pieces 412, 422 is arranged to correspond to the holes 124 of the housing 10, thus, the fixing pieces 412, 422 are respectively inserted into the holes 124 to fix the upper cover 41 on the upper surface of the housing 10 and lower cover on the lower surface of the housing 10.

The insert 30 comprises a main body 31 located between the two side arms 12 of the housing 10 and two pair of fastening portions 321, 322 fixing the insert 30 on the housing 10. The main body 31 has a grid 311 to form some passages 312 corresponding to the troughs 142 of the supporting portion 14 to receive cables 50. Each pair of fastening portions comprises two fastening portions respectively extending form the two opposite sides of the main body 31 along two opposite directions. Each of the fastening portions 321, 322 comprises a rib 3210/3220 on the middle of the front surface thereof to make the fastening portion 321, 322 respectively interferentially inserted into the receiving slots 120, 121 of the housing 10. Thus, the insert 30 is arranged side by side with the housing 10 to make the lower surfaces of both the insert 30 and connecting portion 14 on a same plane to reduce the height of the integrated cable connector 100. Cables 50 respectively pass through the corresponding one of the passages 312 to be soldered on the connecting piece 212 of the terminals 20. When cables 50 are soldered on the terminals 20, the step-shape structure of the terminals 20 make soldering tin not flow to the mating pieces 211 of the terminals 20, thus, the mating pieces 211 is able to transmit current well.

Figure 5:
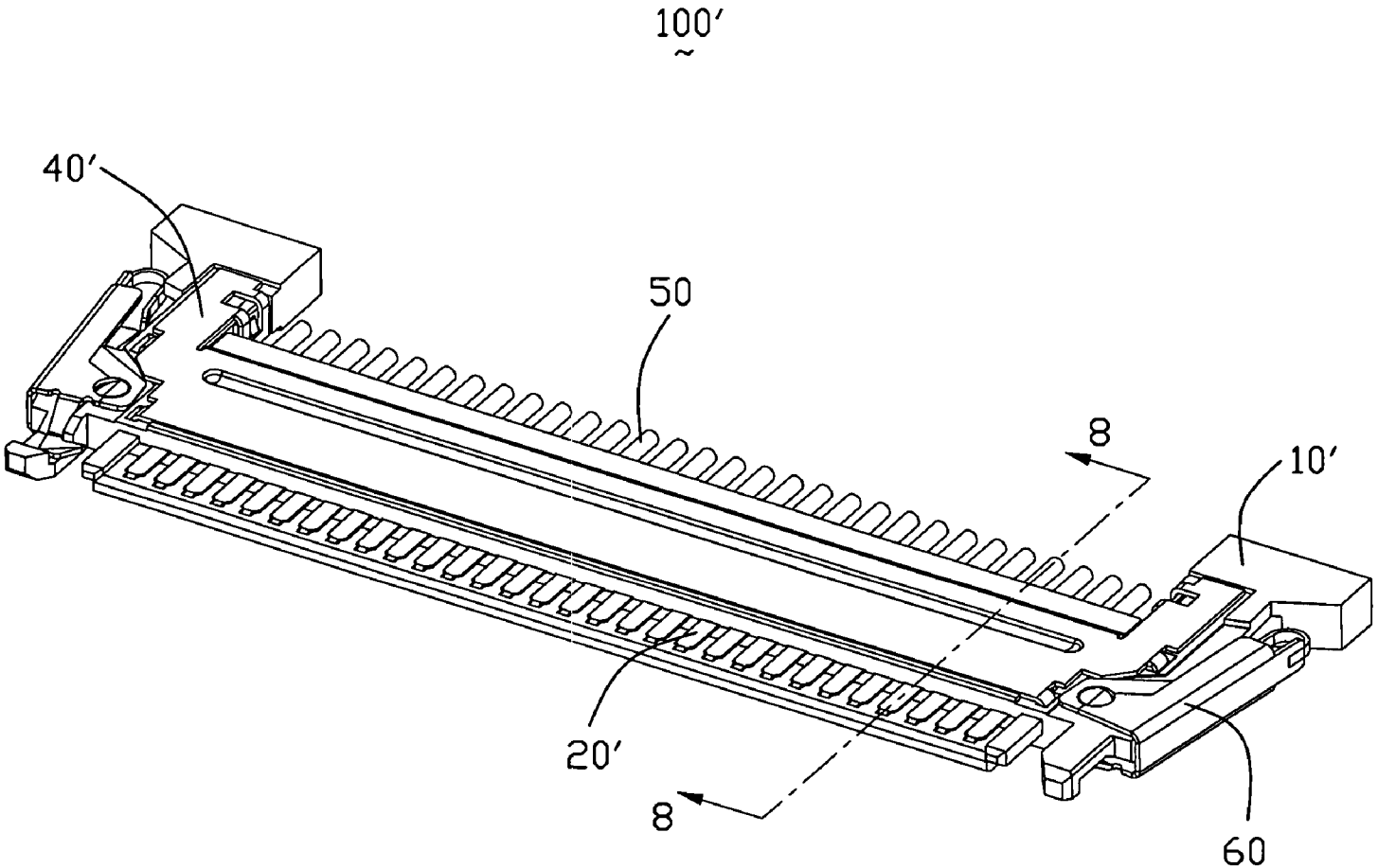
FIG. 5 is a perspective view illustrating a second embodiment of a cable connector in according with the present invention.
Figure 6:
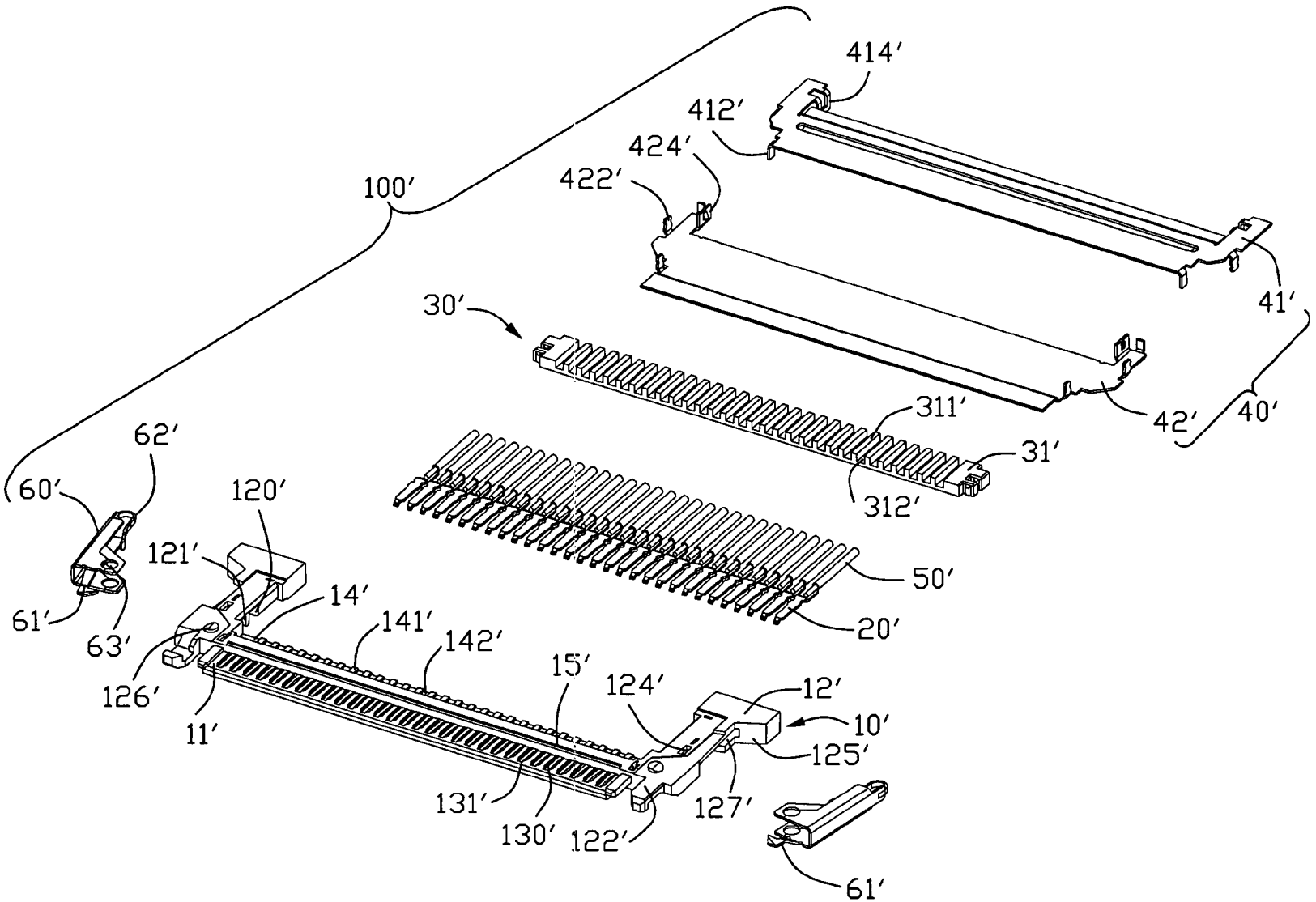
FIG. 6 is an exploded, perspective view of FIG. 5.
Figure 7:
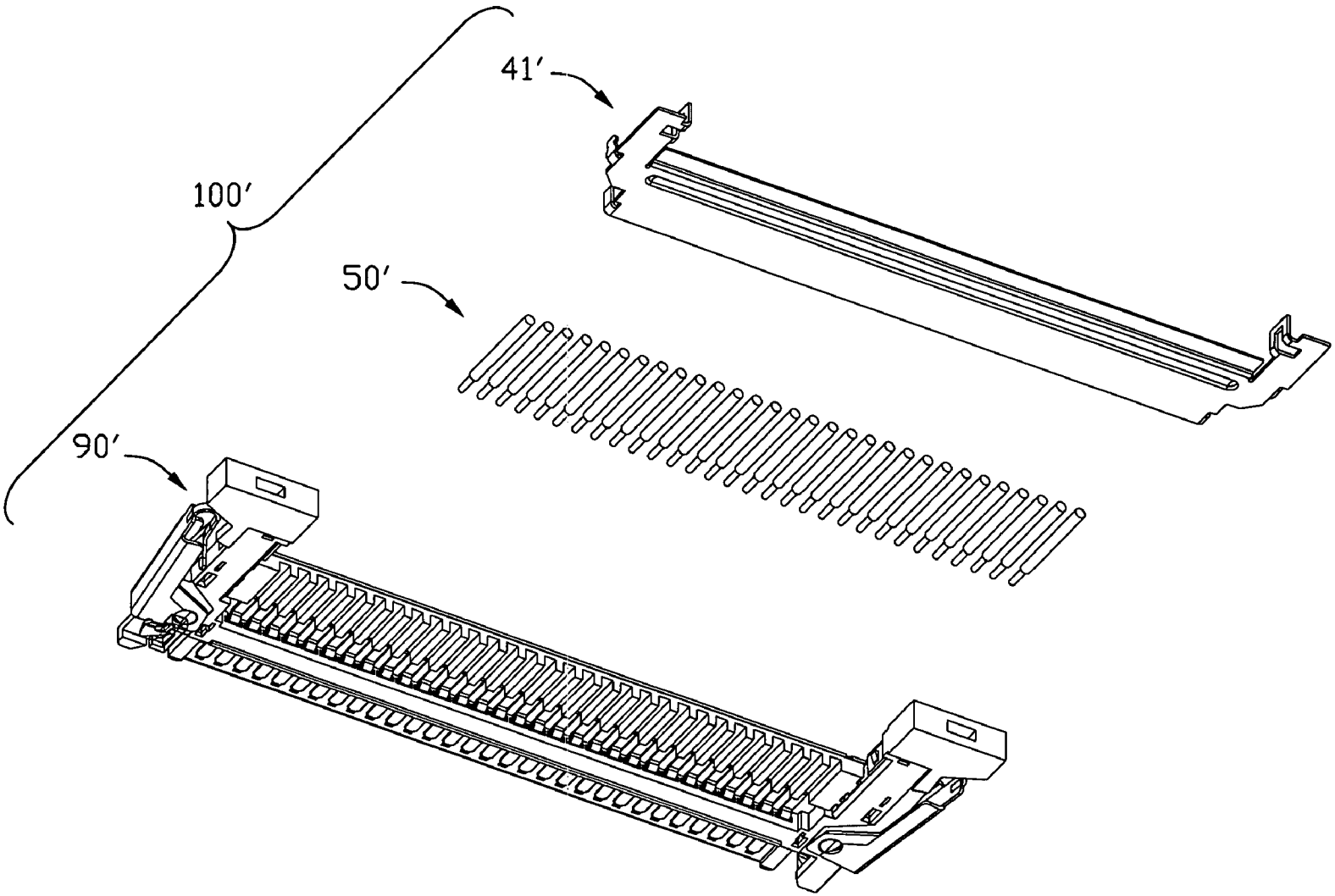
FIG. 7 is a partially assembled view of the cable connector assembly of FIG. 6.
Figure 8:
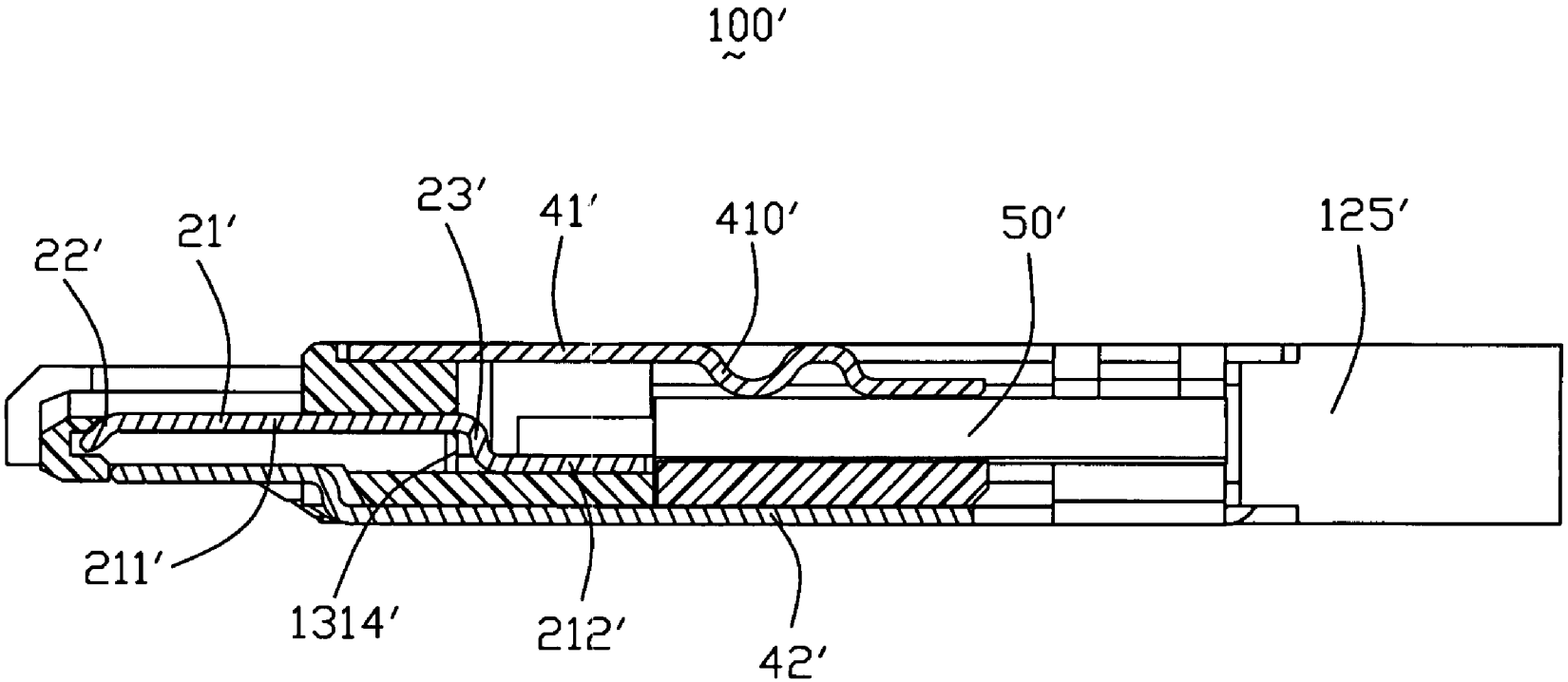
FIG. 8 is a cross-section view taken along lines 8-8 of FIG. 5.

Reference to FIG. 5 and FIG. 9, a cable connector in according with a second embodiment of the present invention is shown. The cable connector 100' comprises a insulative housing 10', a group of terminals 20', an insert 30', a metal shield 40', some wires 50' and a pair of latches 60'.

The terminals 20' are received in the housing 10'. Each terminal 20' comprises a lathy mating piece 211' to form a the forward part thereof, a lathy connecting piece 212' to form the rearward part thereof and a slight protrusion 21' forward extending from the middle of the nose of the mating piece 211'. The mating piece 211' is higher than the connecting piece 212' to form a step-shape structure.

The insulative housing 10' comprises a first main body 11' and a pair of side arms 12' extending from the two sides of the main body 11'. The main body 11' comprises a mating portion 13' to form a forward section thereof, a supporting portion 14' to form a rearward section thereof, and a bar 15' across the mating portion 13' to be connected to said two side arms 12'. The mating portion 13' has some grooves 130', each of which is aligned with each other, to receive the mating pieces 211' of the terminals 20'. Each groove 130' has a contracting portion 131' on the top thereof to receive the protrusions 22' of the terminals 20'. The supporting portion 14' has a grid 141' to form some through 142' corresponding to the grooves 130' of the mating portion 13' to receive the connecting pieces 212' of the terminals 20'. The grooves 130' are on the upper surface of the mating portion 13' and the through 142' are on the upper surface of the supporting portion 14'. Thus, the bar 15' crosses all grooves 130' to presses the terminals 20' received in the housing 10' to protect these terminals 20' from moving. The mating portion 13' is higher than the supporting portion 14' to form a step-shape structure 1314' corresponding to the same structure of the terminals 20'. A receiving space without upper or lower limit is formed between the two tails of the two side arms 12'. Each side arm 12' comprises two separated half-open receiving slots 120', 121' on the lower surface of the tail thereof to be connected to the receiving space, and some holes 124' irregularly distributed thereon.

The metal shield 40' comprises an upper cover 41' and a lower cover 42'. The shape of the upper cover 41' and the lower cover 42' are designed according to the shape of the housing 10'. Some fixing pieces 412', 422' respectively extends from the two sides of both the upper cover 41' and the lower cover 42' to fix the metal shield 40 on the housing 10. The site of the fixing pieces 412', 422' is arranged to correspond to the holes 124' of the housing 10', thus, the fixing pieces 412', 422' are respectively inserted into the holes 124' to fix the upper cover 41' on the upper surface of the housing 10' and the lower cover 42' on the lower surface of the housing 10'.

The insert 30' comprises a main body 31' located between the two side arms 12' of the housing 10' and two pair of fastening portions 321', 322' fixing the insert 30' on the housing 10'. The main body 31' has a grid 311' to form some passages 312' corresponding to the troughs 142' of the supporting portion 14' to receive cables 50'. Each pair of fastening portions 14' comprises two fastening portions 14' respectively extending form the two opposite sides of the main body 31' along two opposite directions. Each of the fastening portions 321', 322' comprises a rib 3210'/3220' on the middle of the front surface thereof to make the fastening portion 321', 322' respectively interferentially inserted into the receiving slots 120', 121' of the housing 10'. Thus, the insert 30' is arranged side by side with the housing 10' to make the lower surfaces of both the insert 30' and connecting portion 14' on a same plane to reduce the height of the integrated cable connector 100'. Cables 50' respectively pass through the corresponding one of the passages 312' to be soldered on the connecting piece 212' of the terminals 20'. When cables 50' are soldered on the terminals 20', the step-shape structure of the terminals 20' make soldering tin not flow to the mating pieces 211' of the terminals 20', thus, the mating pieces 211' is able to transmit current well.

The two latches 60' are respectively connected to the two opposite sides of the housing 10'. Each latch 60' is composed of an upper wall (not signed), a lower wall (not signed) and a side wall (not signed). And each latch 60' comprises a clasp 61' on the forward end of the lower wall, a spring 62' extending from the rear end of the side wall and then reversing to face forward, and a pair of fixing apertures 63' respectively on the upper wall and lower wall. The spring 62', the upper wall and the lower wall are on the same side of the side wall. One fixing aperture 63' is corresponded to one post 126' of the side arm 12' of the housing 10' to fix the latch 61' on the side arm 12'. When one latch 60' is fixed on one side arm 12', the spring 62' touches the outer side of the side arm 12'. For the spring 12' having flexibility, the latch 61' is able to be forced to revolve around the post 126', and then automatically reset when force is released. When latches 60' are revolving, the tails of the latches move inward and the clasps 61' move outward. Thus, when the cable connector 100' is connected to the complementary connector (not shown), the latches 60' make the two connectors connected firmer through the clasps 61' and separated from each other easily under force.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable connector, comprising:

an insulative housing, comprising a main body, and a pair of side arms respectively rearward extending from the middle of the two sides of the main body to form a receiving space between the two side arms, a forward section of said main body being a mating portion with some evenly disposed grooves and a rearward section of said main body being a connecting portion with some toughs corresponding to the grooves, each side arm comprising two receiving slots spaced apart from each other in the rear thereof to be connected to the receiving space;

a group of terminals, each of which comprising a mating piece on the forward part thereof to be received in the mating portion and a connecting piece on the rearward part thereof to be received in the connecting portion;

an insert, comprising a main body with a grid to form some passages corresponding to the troughs of the housing and two pair of fastening portions respectively extending from two sides of the main body, said main body being received in the receiving space between the two side arms of the housing through said fastening portions being inserted into the receiving slots of the housing; and a shield, comprising an upper cover assembled on the upper surface of the housing to cover the connecting portion and the insert, and a lower cover assembled on the lower surface of the housing to cover the connecting portion and the insert.

2. The cable connector as claimed in claim 1, wherein said mating piece of the terminal is higher than said connecting piece to form a step-shape structure, and said mating portion is higher than said connecting portion to form a step-shape structure corresponding to match the terminal.

3. The cable connector as claimed in claim 1, wherein said terminal further comprises a protrusion and said mating portion of the housing comprises a contracting portion to receive said protrusion.

4. The cable connector as claimed in claim 1, wherein said housing further comprises a bar crossing all the grooves to connect to said two side arms.

5. The cable connector as claimed in claim 1, wherein said lower surface of the connecting portion of the housing and the lower surface of the insert are located at a same plane.

6. The cable connector as claimed in claim 1, wherein each of said fastening portions of the insert comprises a rib on the middle of the front surface thereof.

7. The cable connector as claimed in claim 1, wherein each of said cables comprises an inner conductor connected to the connecting piece of the terminal and an outer conductor.

8. The cable connector as claimed in claim 7, wherein said upper cover comprises a lengthwise rib inward extending from the upper surface thereof to be soldered with the cables.

9. The cable connector as claimed in claim 1, wherein said cable connector further comprises a pair of latch respectively assembled on the two side arms of the cable connector.

10. The cable connector as claimed in claim 1, wherein each said latch is composed of an upper wall, a lower wall and a side wall connecting the upper wall and the lower wall.

11. The cable connector as claimed in claim 10, wherein each said latch comprises a clasp on the forward end of the lower wall, a spring extending from the rear end of the side wall and then reversing to face forward, and a pair of fixing apertures respectively on the upper wall and tower wall.

* * * * *